US011118776B2

(12) United States Patent
Lin et al.

(10) Patent No.: US 11,118,776 B2
(45) Date of Patent: Sep. 14, 2021

(54) DOWNLIGHT APPARATUS

(71) Applicant: XIAMEN ECO LIGHTING CO. LTD., Xiamen (CN)

(72) Inventors: Hongbin Lin, Xiamen (CN); Lianguang Wang, Xiamen (CN); Liangliang Cao, Xiamen (CN); Mingyan Fu, Xiamen (CN); Wunchang Huang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/859,916

(22) Filed: Apr. 27, 2020

(65) Prior Publication Data

US 2021/0199275 A1 Jul. 1, 2021

(51) Int. Cl.

| | |
|---|---|
| ***F21V 29/70*** | (2015.01) |
| ***F21S 8/02*** | (2006.01) |
| ***F21V 23/00*** | (2015.01) |
| ***F21Y 115/10*** | (2016.01) |

(52) U.S. Cl.

CPC ..... *F21V 29/70* (2015.01); *F21S 8/02* (2013.01); *F21V 23/009* (2013.01); *F21Y 2115/10* (2016.08)

(58) Field of Classification Search

CPC ..... F21V 29/70; F21V 27/10; F21V 23/009; F21V 23/003; F21V 23/005; F21V 29/508; F21V 29/10; F21S 8/02; F21S 8/026; F21Y 2115/10

See application file for complete search history.

(56) References Cited

U.S. PATENT DOCUMENTS

| | | | | |
|---|---|---|---|---|
| 9,310,038 | B2 * | 4/2016 | Athalye | F21V 7/24 |
| 9,557,021 | B2 * | 1/2017 | Madden | F21V 23/008 |
| 10,041,654 | B1 * | 8/2018 | Ernst | F21S 8/026 |
| 10,047,944 | B2 * | 8/2018 | O'Brien | F21V 21/04 |
| 2011/0075423 | A1 * | 3/2011 | Van De Ven | F21V 17/162 362/249.02 |
| 2014/0185291 | A1 * | 7/2014 | Gotay | F21V 29/15 362/249.01 |
| 2016/0025315 | A1 * | 1/2016 | Igaki | H05B 45/00 362/382 |
| 2017/0227207 | A1 * | 8/2017 | Bendtsen | F21V 29/508 |
| 2019/0032874 | A1 * | 1/2019 | Bonnetto | F21V 5/043 |

* cited by examiner

*Primary Examiner* — Peggy A Neils

(74) *Attorney, Agent, or Firm* — Chun-Ming Shih; Lanway IPR Services

(57) ABSTRACT

A downlight apparatus includes a light passing cover, a light source module, a surface rim and a driver plate. The surface rim has a rim part, a reflection part and a bottom part. The rim part is connected to the reflection part. The reflection part is connected to a top edge of the bottom part. The bottom part defines an installation cavity with the top edge as a cavity opening. The rim part defines a light opening. A first light of the plurality of LED modules passes through the light passing cover and a second light of the plurality of LED modules is reflected by the reflection part before passing through the light passing cover. The rim part, the reflection part and the bottom part are made of the same material as a unibody module.

18 Claims, 15 Drawing Sheets

Flg. 7

DOWNLIGHT APPARATUS

FIELD

The present invention is related to a downlight apparatus and more particularly related to a downlight apparatus with a low cost and convenient design.

BACKGROUND

Lighting or illumination is the deliberate use of light to achieve a practical or aesthetic effect. Lighting includes the use of both artificial light sources like lamps and light fixtures, as well as natural illumination by capturing daylight. Daylighting (using windows, skylights, or light shelves) is sometimes used as the main source of light during daytime in buildings. This can save energy in place of using artificial lighting, which represents a major component of energy consumption in buildings. Proper lighting can enhance task performance, improve the appearance of an area, or have positive psychological effects on occupants.

Indoor lighting is usually accomplished using light fixtures, and is a key part of interior design. Lighting can also be an intrinsic component of landscape projects.

A light-emitting diode (LED) is a semiconductor light source that emits light when current flows through it. Electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light is obtained by using multiple semiconductors or a layer of light-emitting phosphor on the semiconductor device.

Appearing as practical electronic components in 1962, the earliest LEDs emitted low-intensity infrared light. Infrared LEDs are used in remote-control circuits, such as those used with a wide variety of consumer electronics. The first visible-light LEDs were of low intensity and limited to red. Modern LEDs are available across the visible, ultraviolet, and infrared wavelengths, with high light output.

Early LEDs were often used as indicator lamps, replacing small incandescent bulbs, and in seven-segment displays. Recent developments have produced white-light LEDs suitable for room lighting. LEDs have led to new displays and sensors, while their high switching rates are useful in advanced communications technology.

LEDs have many advantages over incandescent light sources, including lower energy consumption, longer lifetime, improved physical robustness, smaller size, and faster switching. Light-emitting diodes are used in applications as diverse as aviation lighting, automotive headlamps, advertising, general lighting, traffic signals, camera flashes, lighted wallpaper and medical devices.

Unlike a laser, the color of light emitted from an LED is neither coherent nor monochromatic, but the spectrum is narrow with respect to human vision, and functionally monochromatic.

The energy efficiency of electric lighting has increased radically since the first demonstration of arc lamps and the incandescent light bulb of the 19th century. Modern electric light sources come in a profusion of types and sizes adapted to many applications. Most modern electric lighting is powered by centrally generated electric power, but lighting may also be powered by mobile or standby electric generators or battery systems. Battery-powered light is often reserved for when and where stationary lights fail, often in the form of flashlights, electric lanterns, and in vehicles.

Although lighting devices are widely used, there are still lots of opportunity and benefit to improve the lighting devices to provide more convenient, low cost, reliable and beautiful lighting devices for enhancing human life.

SUMMARY

In some embodiments, a downlight apparatus includes a light passing cover, a light source module, a surface rim and a driver plate.

The light source module has a plurality of LED modules. The surface rim has a rim part, a reflection part and a bottom part. The rim part is connected to the reflection part. The reflection part is connected to a top edge of the bottom part. The bottom part defines an installation cavity with the top edge as a cavity opening. The rim part defines a light opening. A first light of the plurality of LED modules passes through the light passing cover and a second light of the plurality of LED modules is reflected by the reflection part before passing through the light passing cover. The rim part, the reflection part and the bottom part are made of the same material as a unibody module.

The driver plate is disposed upon the top edge of the bottom part. A first side of the driver plate is attached with the light source module, a second side of the driver plate are attached with at least one driver component.

The first side faces to the light passing cover. The second side faces to the installation cavity. The at least one driver component is stored in the installation cavity.

In some embodiments, the downlight apparatus also includes a heat dissipation box made of heat conductive material. The heat dissipation box is placed into the installation cavity, and surrounding the at least one driver component.

In some embodiments, the heat dissipation box has a tube body with a bottom plate. An external wall of the tube body contacts the inner wall of the bottom part of the surface rim.

In some embodiments, the heat dissipation box has a surrounding wall, a surrounding cavity and a central platform. The driver plate is placed on the central platform and covering the surrounding cavity. The at least one driver component is placed in the surrounding cavity.

In some embodiments, there are multiple cavity sections for respectively storing different driver components.

In some embodiments, a processor circuit is placed in a first cavity section and a transformer circuit is placed in a second cavity section away from the first cavity section. In such arrangement, processors that execute complicated functions would be kept away from strong electromagnetic components to keep the overall system more reliable.

In some embodiments, the driver component with wireless communication function is placed at a different cavity section from other driver component without wireless communication function.

In some embodiments, the heat dissipation box is heat connection with the bottom part of the surface rim. Such design is found to provide a higher signal to noise ratio circuit design.

In some embodiments, the reflective part is detachably connected to an attached device.

In some embodiments, the reflection part has a plug area for plugging in the attached device.

Such attached device may be integrated with different functions but with the same housing shape and the same power electrodes for receiving power from a driver used for providing a driving current the light source module. Functions of the attached device may include a wireless communication device, a speaker, a battery, a smoke alarm device or any other device that provides additional function to the downlight apparatus.

In some embodiments, the reflective part has a reflective wall. There is an entrance opening on the reflective wall for inserting the attached device. A surface wall of the attached device is integrated with the reflective wall appearing as a complete surrounding wall. In other words, the attached device has a surface wall that may appear just like other part of the reflective wall of the reflective part. When the attached device is inserted, the surface wall together with other part of the reflective wall form a complete surrounding wall for reflecting light of the light source module.

In some embodiments, a surface wall of the attached device has a reflection layer for reflecting the second light of the light source module.

In some embodiments, there is a coil concealed inside the reflective part for supplying power to the attached device.

In some embodiments, the attached device is placed in a container space concealed by the rim part and the reflective part.

In some embodiments, positions of the multiple LED modules on the first side of the driver plate are kept away from the at least one driver component on the second side of the driver plate.

In some embodiments, the multiple LED modules are located in a center area of the first side of the driver plate, the at least one driver component is located at a peripheral area of the second side of the driver plate.

In some embodiments, the multiple LED modules are located in a peripheral area of the first side of the driver plate. The at least one driver component is located at a center area of the second side of the driver plate.

In some embodiments, there is a second driver component disposed on the first side of the driver plate. A second height of the second driver component is smaller than a first height of the at least one driver component on the second side of the driver plate.

In some embodiments, the at least one driver component has a protruding pin from the second side of the driver plate passing through a through hole reaching a fastener on the first side of the driver plate for providing a driving current to the multiple LED modules.

In some embodiments, the at least one driver component, the driver plate and the light source are made as an integrated module to be placed into the installation cavity directly.

DETAILED DESCRIPTION

Figure 7:
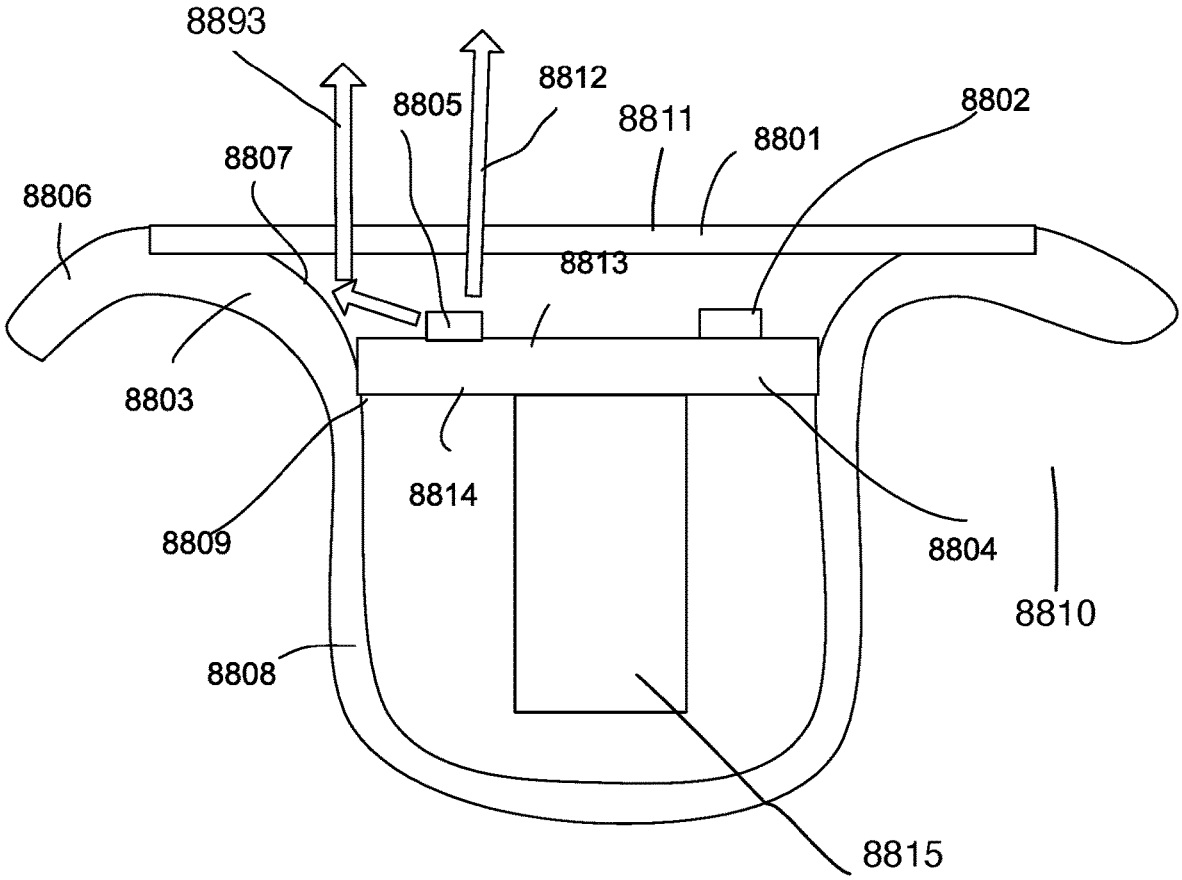
FIG. 7 is a schematic side view of the downlight apparatus according to an embodiment of the present disclosure.

In FIG. 7, a downlight apparatus includes a light passing cover 8801, a light source module 8802, a surface rim 8803 and a driver plate 8804.

The light source module 8802 has a plurality of LED modules 8805. The surface rim 8803 has a rim part 8806, a reflection part 8807 and a bottom part 8808. The rim part 8806 is connected to the reflection part 8807. The reflection part 8807 is connected to a top edge 8809 of the bottom part 8808. The bottom part 8808 defines an installation cavity 8810 with the top edge 8809 as a cavity opening. The rim part 8803 defines a light opening 8811. A first light 8812 of the plurality of LED modules 8802 passes through the light passing cover 8801 and a second light 8893 of the plurality of LED modules 8802 is reflected by the reflection part 8807 before passing through the light passing cover 8801. The rim part 8806, the reflection part 8807 and the bottom part 8808 are made of the same material as a unibody module.

The driver plate 8804 is disposed upon the top edge 8809 of the bottom part 8808. A first side 8813 of the driver plate 8804 is attached with the light source module 8802, a second side 8884 of the driver plate 8804 are attached with at least one driver component 8815.

The first side 8813 faces to the light passing cover 8801. The second side 8814 faces to the installation cavity 8810. The at least one driver component 8815 is stored in the installation cavity 8810.

Figure 8:
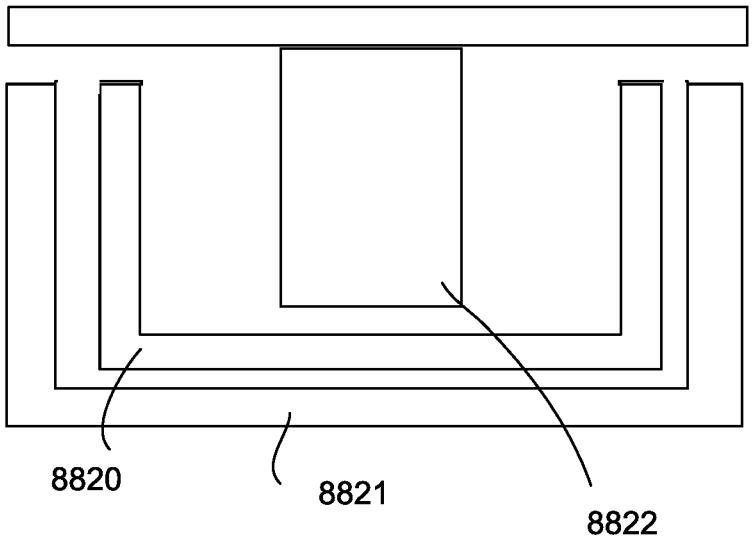
FIG. 8 is a schematic view of a heat dissipation box according to an embodiment of the present disclosure.

In FIG. 8, the downlight apparatus also includes a heat dissipation box 8820 made of heat conductive material. The heat dissipation box 8820 is placed into the installation cavity 8821, and surrounding the at least one driver component 8822.

Figure 9:
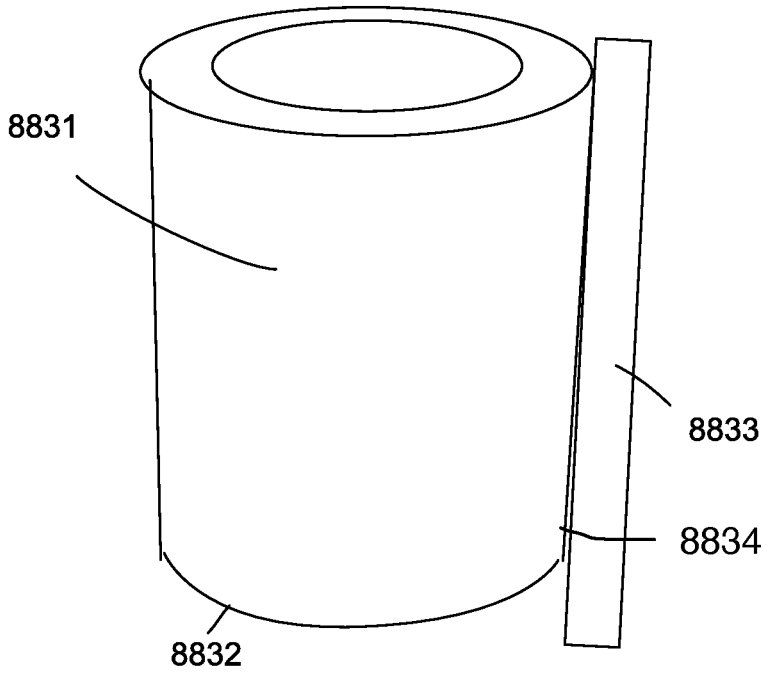
FIG. 9 is a schematic view of the heat dissipation box according to an embodiment of the present disclosure.

In FIG. 9, the heat dissipation box has a tube body 8831 with a bottom plate 8832. An external wall 8833 of the tube body contacts the inner wall 8834 of the bottom part of the surface rim.

Figure 1:
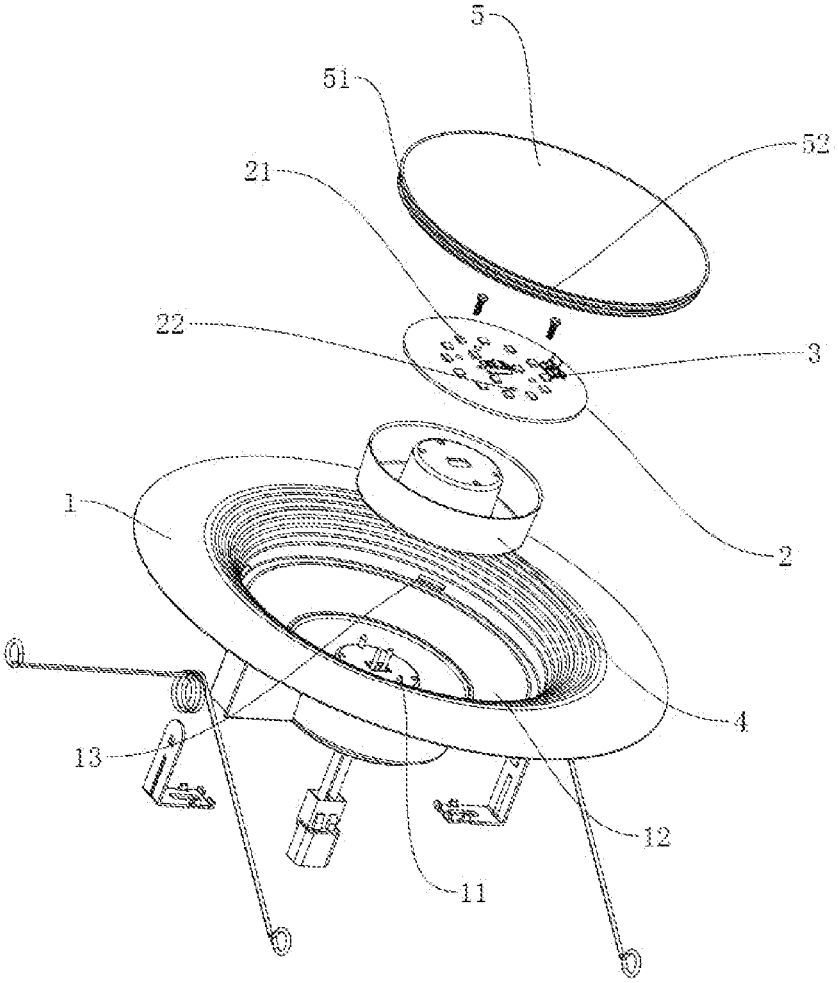
FIG. 1 is an exploded perspective view of a downlight apparatus according to an embodiment of a present disclosure.
Figure 10:
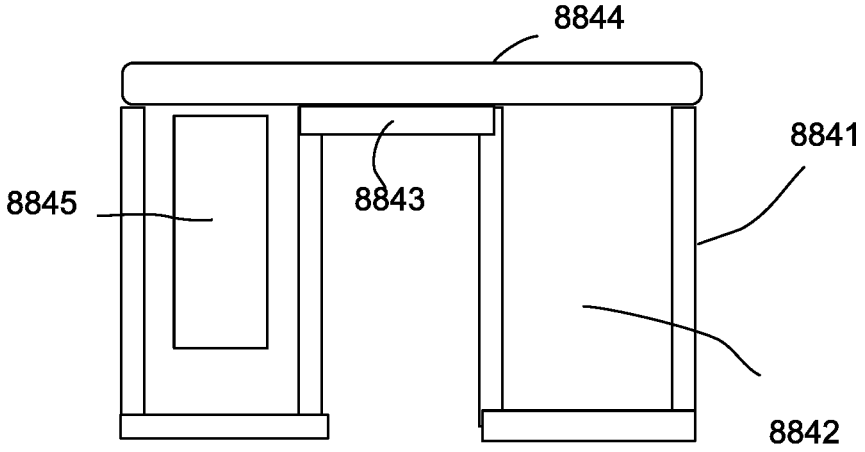
FIG. 10 is a schematic partial view of the heat dissipation box according to an embodiment of the present disclosure.

In FIG. 10, the heat dissipation box like the heat dissipation box 4 in FIG. 1, the heat dissipation box has a surrounding wall 8841, a surrounding cavity 8842 and a central platform 8843. The driver plate 8844 is placed on the central platform 8843 and covering the surrounding cavity 8842. The at least one driver component 8845 is placed in the surrounding cavity 8842.

Figure 11:
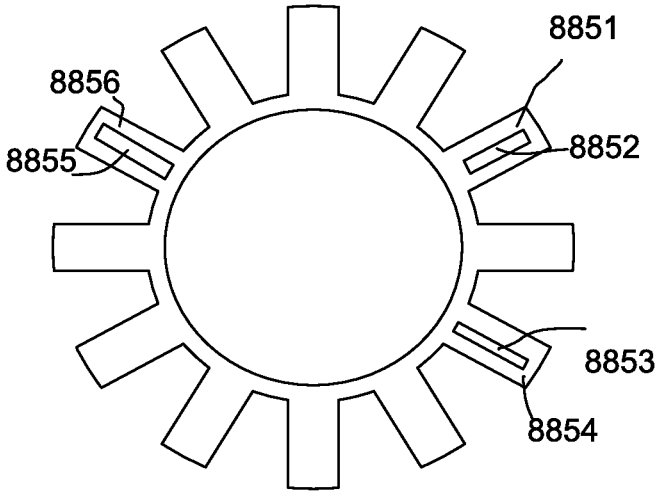
FIG. 11 is a schematic partial view of the downlight apparatus according to an embodiment of the present disclosure.

In FIG. 11, there are multiple cavity sections 8851 for respectively storing different driver components 8852.

For example, a processor circuit 8853 is placed in a first cavity section 8854 and a transformer circuit 8855 is placed in a second cavity section 8856 away from the first cavity section 8854. In such arrangement, processors that execute complicated functions would be kept away from strong electromagnetic components to keep the overall system more reliable.

In some embodiments, the driver component with wireless communication function is placed at a different cavity section from other driver component without wireless communication function.

In some embodiments, the heat dissipation box is heat connection with the bottom part of the surface rim. Such design is found to provide a higher signal to noise ratio circuit design.

Figure 12:
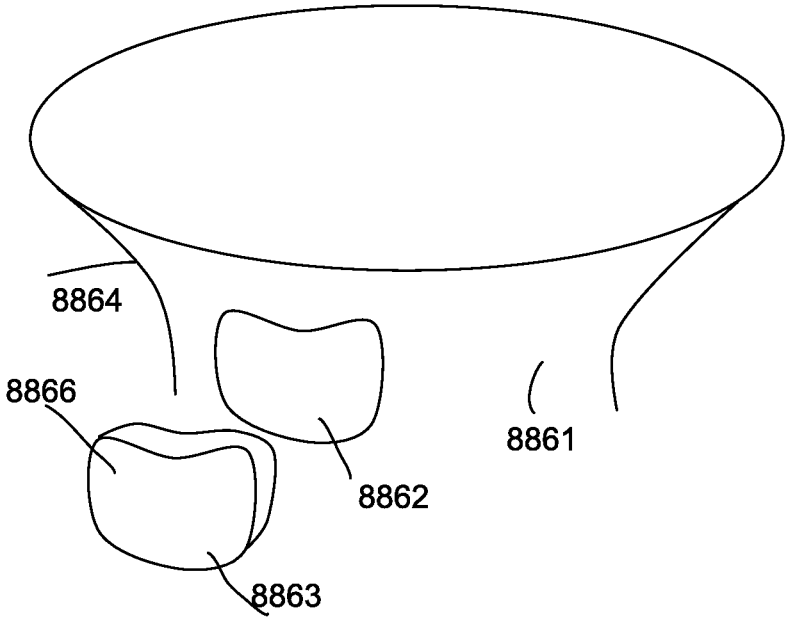
FIG. 12 is a schematic partial view of the downlight apparatus according to an embodiment of the present disclosure.

In FIG. 12, the reflective part 8861 is detachably connected to an attached device 8862.

In FIG. 12, the reflection part 8861 has a plug area 8862 for plugging in the attached device 8863.

Such attached device 8862 may be integrated with different functions but with the same housing shape and the same power electrodes for receiving power from a driver used for providing a driving current the light source module. Functions of the attached device may include a wireless communication device, a speaker, a battery, a smoke alarm device or any other device that provides additional function to the downlight apparatus.

In FIG. 12, the reflective part 8861 has a reflective wall 8864. There is an entrance opening 8865 on the reflective wall 8864 for inserting the attached device 8863. A surface wall 8866 of the attached device 8863 is integrated with the reflective wall 8864 appearing as a complete surrounding wall.

In other words, the attached device has a surface wall that may appear just like other part of the reflective wall of the reflective part. When the attached device is inserted, the surface wall together with other part of the reflective wall form a complete surrounding wall for reflecting light of the light source module.

In some embodiments, a surface wall of the attached device has a reflection layer for reflecting the second light of the light source module.

Figure 13:
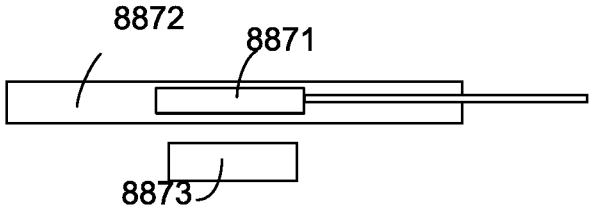
FIG. 13 is a schematic partial view of the downlight apparatus according to an embodiment of the present disclosure.

In FIG. 13, there is a coil 8871 concealed inside the reflective part 8872 for supplying power to the attached device 8873. With the wireless charging, there is no need to reserve an electronic electrode explicitly to provide more safety for user.

Figure 14:
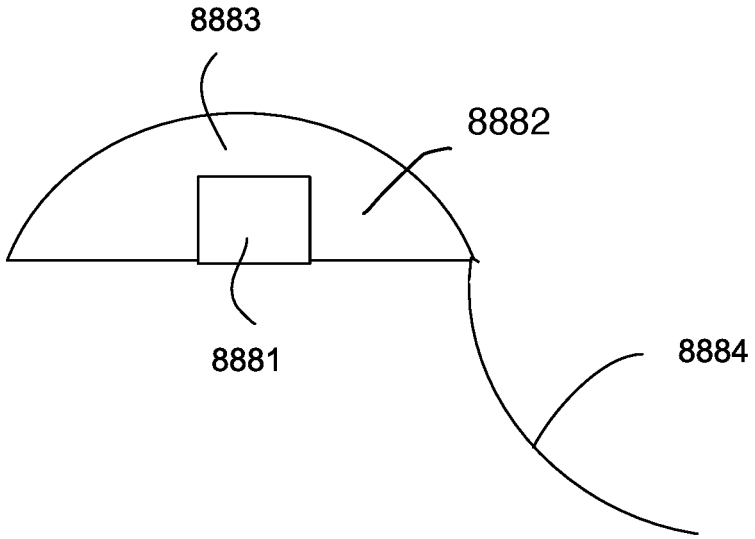
FIG. 14 is a schematic partial view of the downlight apparatus according to an embodiment of the present disclosure.

In FIG. 14, the attached device 8881 is placed in a container space 8882 concealed by the rim part 8883 and the reflective part 8884. In other words, the attached device may be plugged behind the rim part so that the attached device 8881 is hidden while still works for providing certain functions like wireless communication, detection of sound or other functions.

Figure 15:
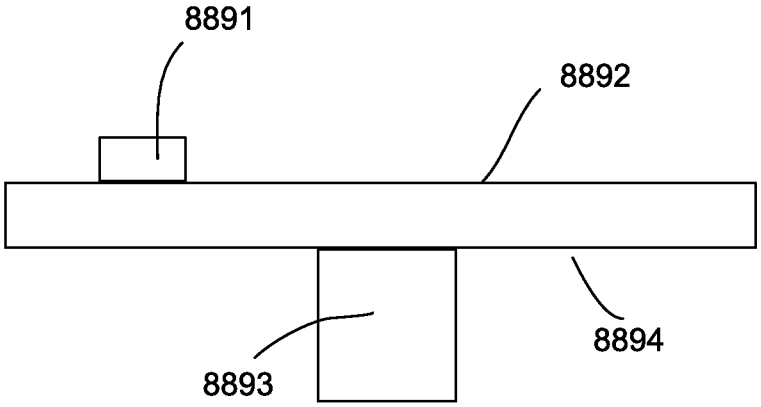
FIG. 15 is a schematic partial view of the downlight apparatus according to an embodiment of the present disclosure.

In FIG. 15, positions of the multiple LED modules 8891 on the first side 8892 of the driver plate are kept away from the at least one driver component 8893 on the second side 8894 of the driver plate.

In some embodiments, the multiple LED modules are located in a center area of the first side of the driver plate, the at least one driver component is located at a peripheral area of the second side of the driver plate.

In some embodiments, the multiple LED modules are located in a peripheral area of the first side of the driver plate. The at least one driver component is located at a center area of the second side of the driver plate.

In some embodiments, there is a second driver component disposed on the first side of the driver plate. A second height of the second driver component is smaller than a first height of the at least one driver component on the second side of the driver plate.

In some embodiments, the at least one driver component has a protruding pin from the second side of the driver plate passing through a through hole reaching a fastener on the first side of the driver plate for providing a driving current to the multiple LED modules.

In some embodiments, the at least one driver component, the driver plate and the light source are made as an integrated module to be placed into the installation cavity directly.

Figure 5:
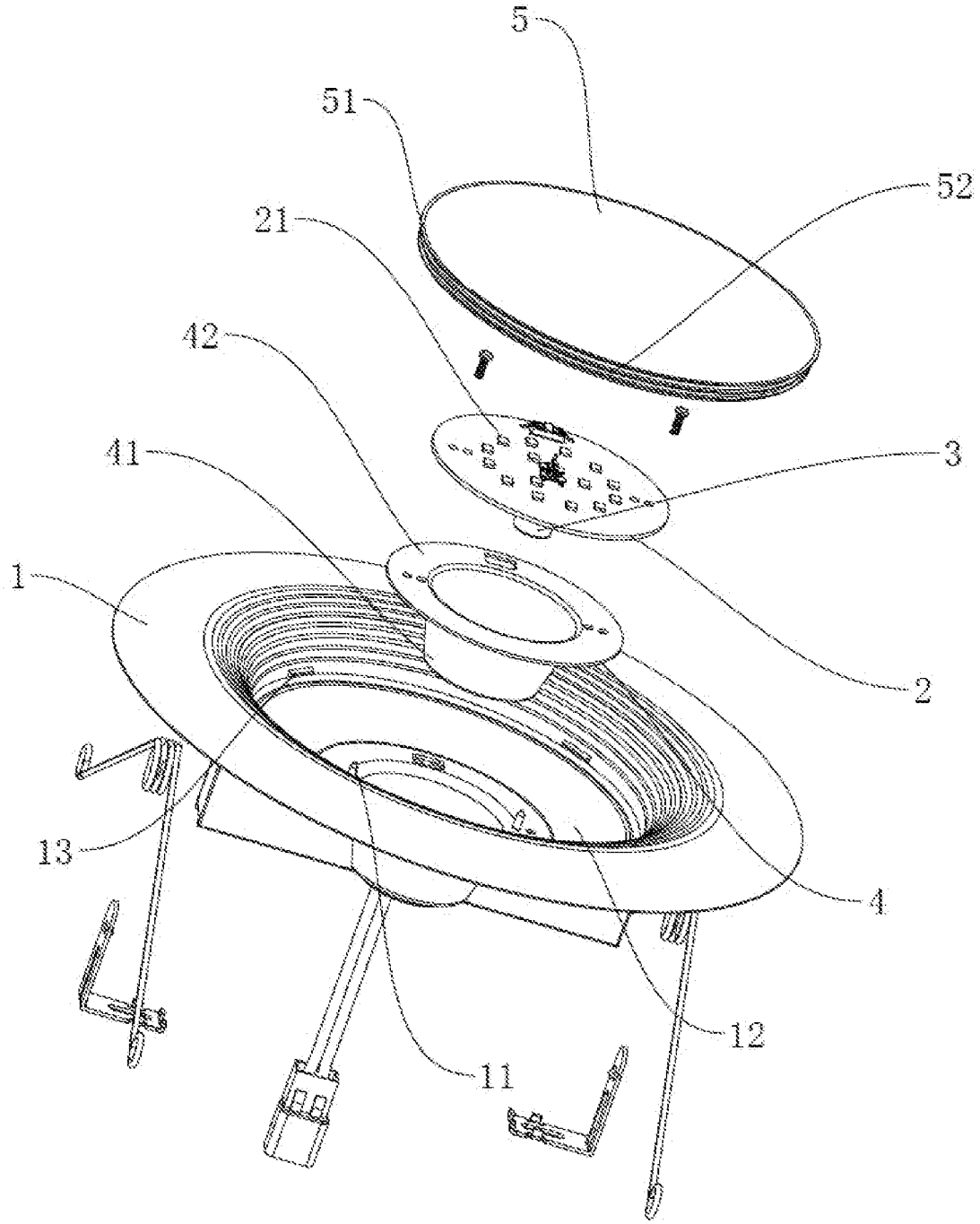
FIG. 5 is an exploded perspective view of the downlight apparatus according to an embodiment of the present disclosure.

Please refer to FIG. 1 and FIG. 5. A downlight apparatus has a surface rim 1 having an installation cavity disposed on a bottom and a circuit board 2 disposed on the bottom of the surface rim. The circuit board 2 is covered and disposed at an opening part of the installation cavity. A light source module 21 is disposed on a peripheral side of the circuit board 2 being away from the installation cavity. A driver component 3 is disposed on the other side of the circuit board 2. The driver component 3 connects electrically with the light source module 21 through the circuit board. The driver component 3 is in the installation cavity.

In this embodiment of the LED downlight, the installation cavity is disposed on the bottom of the surface rim 1. The circuit board 2 is covered and disposed on the opening part of the installation cavity. The light source module 21 and the driver component 3 are respectively disposed on both sides of the circuit board 2. The driver component 3 on the circuit board 2 is in the installation cavity. The surface rim 1 is an unibody structure to strengthen the firmness and heat dissipation of the downlight. The driver component 3 and the light source module 21 are respectively disposed on both sides of the circuit board 2 to make the driver component 3 is not on the same side of the circuit board 2 with the light source module 21, and further to eliminate the influence of the driver component 3 on the optical effect of the light source module 21. The deletion of a reflection cup decreases the manufacturing cost of the LED downlight. During the installation process, only the circuit board 2 is needed to be disposed on the bottom of the surface rim 1. The installation process of the downlight apparatus is simplified, and the production efficiency is improved.

In this embodiment, the light source module 21 adopts LED chips. The number of the LED chips is plurality, and the LED chips are capable of being arranged according to the design. A connecting seat is disposed on the circuit board 2. The connecting seat connects with external power source. The driver component 3 electrically connects with the LED chips through the circuit board 2.

Please refer to FIG. 1 to FIG. 4. A fixing column 14 is disposed in the installation cavity. The fixing column 14 is used for fixing the circuit board 2. The circuit board 2 engages on an end surface of the fixing column 14. The driver component 3 is in the space between the fixing column 14 and a side wall of the installation cavity. The driver component 3 is disposed near the edge of the circuit board 2. The fixing column 14 and the surface rim 1 are the unibody molding structure. The fixing column 14 protrudes from the bottom of the installation cavity. The installation of the fixing column 14 strengthens the installation of the circuit board 2, and further increases the production efficiency of the downlight.

Figure 2:
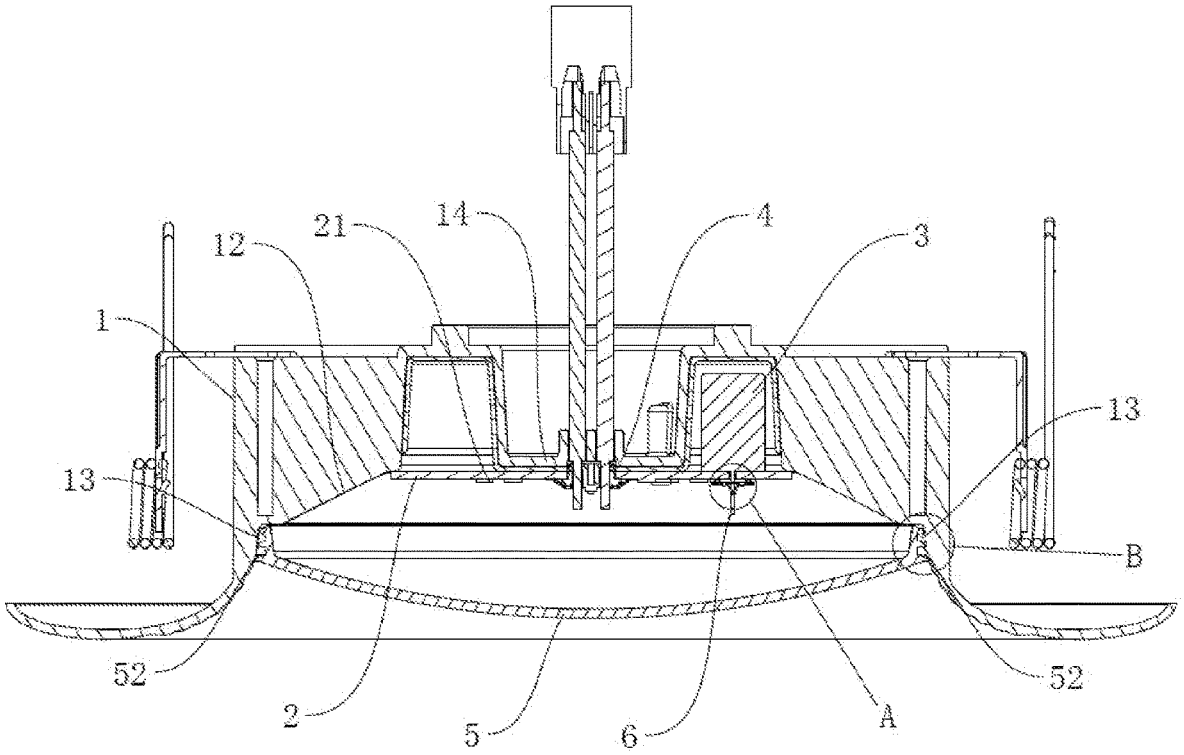
FIG. 2 is a perspective side view of the downlight apparatus according to an embodiment of the present disclosure.

Please refer to FIG. 1 and FIG. 2. A plurality of positioning column 11 is disposed on the top of the fixing column 14. The positioning column 11 is used for positioning the circuit board 2. A positioning hole 22 is disposed on the circuit board 2. The positioning hole 22 is match with the position of the positioning column 11 and is used for containing the positioning column 11. The circuit board 2 is fixed on the surface rim 1 by a fastener. Also, the circuit board 2 is capable of connecting with a hook or a buckle and tightly touches an inner wall of the surface rim 1. The installation of the positioning column 11 and the positioning hole 22 is capable of quickly positioning during the installation of the circuit board 2, and to speed up the installation process of the circuit board 2.

Please refer to FIG. 1 to FIG. 4. An installation platform is disposed on the bottom of the surface rim 1. The installation platform is used for fixing the circuit board 2. The installation platform is on the ring of the installation cavity. The ring of the circuit board 2 presses on the installation platform. The driver component 3 is disposed on the center of the circuit board 2. The installation platform is disposed on the ring of the opening part of the installation cavity. The installation of the installation platform strengthens the installation of the circuit board 2 and to further increase the production efficiency of the downlight.

Please refer to FIG. 1 to FIG. 4. A plurality of the positioning column 11 is disposed on the installation platform. The positioning column 11 is used for positioning the circuit board 2. The positioning hole 22 is disposed on the circuit board 2. The positioning hole 22 is match with the position of the positioning column 11 and is used for containing the positioning column 11. The circuit board 2 is fixed on the surface rim 1 by a fastener. Also, the circuit board 2 is capable of connecting with a hook or a buckle and tightly touches an inner wall of the surface rim 1. The installation of the positioning column 11 and the positioning hole 22 is capable of quickly positioning during the installation of a heat dissipation box 4 and the circuit board 2, and to speed up the installation process of the circuit board 2.

Please refer to FIG. 1 to FIG. 6. A reflection surface 12 is disposed on the inner wall of the surface rim 1. The reflection surface 12 is on the ring of the light source module 21. A light passing plate 5 is disposed on the opening part of the surface rim 1. The light emitted by the light source module 21 passes through the light passing plate 5. Part of the light emitted from the light source module 21 to the surface rim 1 reflects through the refection surface 12 and passes through the light passing plate 5 to diffuse, and to further increase the luminance effect of the LED downlight.

Figure 6:
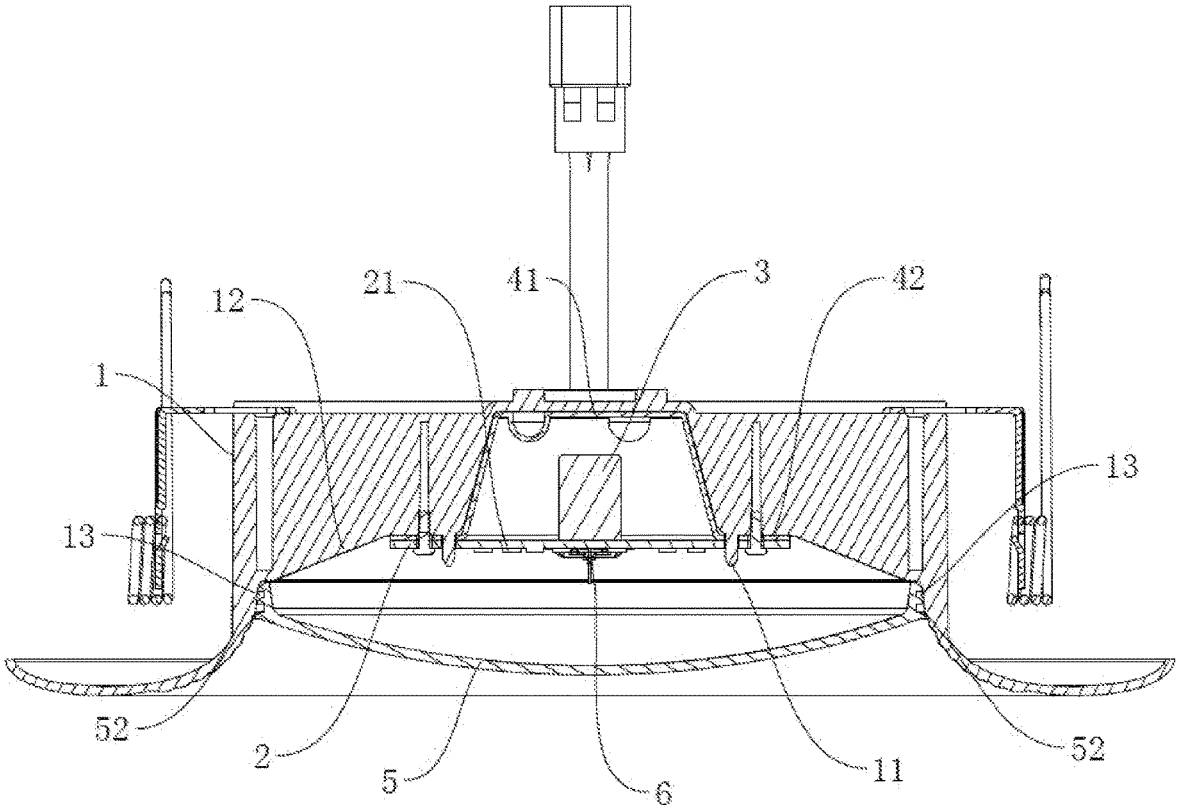
FIG. 6 is a perspective side view of the downlight apparatus according to an embodiment of the present disclosure.

Please refer to FIG. 6 and FIG. 7. A fixing module is disposed on the surface rim 1. The fixing module is used for fixing the light passing plate 5. The light passing plate 5 is disposed on the opening part of the installation cavity. The fixing module strengthens the installation of the light passing plate 5. The fixing module is a plurality of a fixing plug 13. The fixing plug 13 is disposed on the opening part of the installation cavity. An installation façade 51 is disposed on the ring of the light passing plate 5. A buckle slot 52 is disposed on the installation façade 51. The buckle slot 52 is used for containing the fixing plug 13. Place the light passing plate 5 on the opening part of the installation cavity, and press the light passing plate 5 to fix the fixing plug 13 to the buckle slot 52 to finish the installation of the light passing plate 5.

Figure 3:
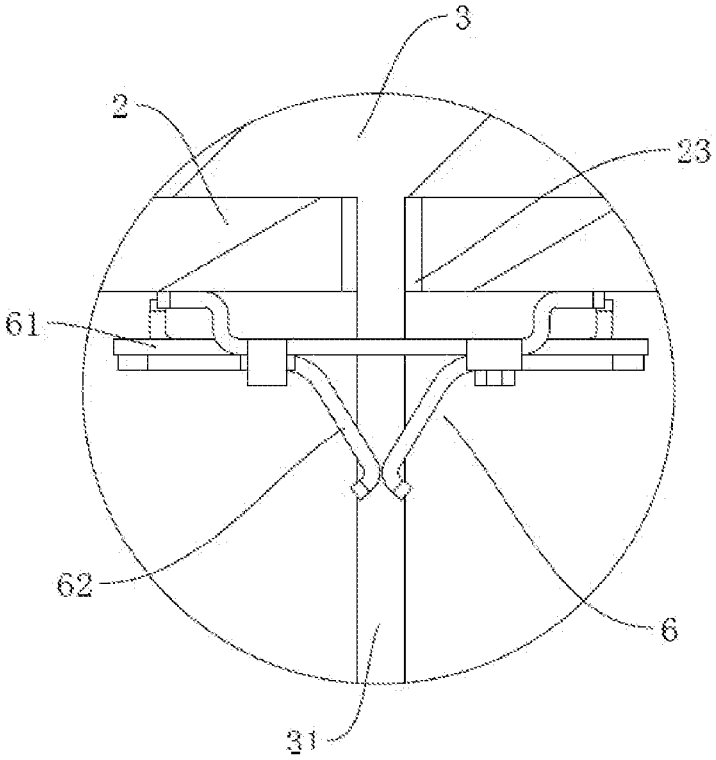
FIG. 3 is a partial view of the downlight apparatus according to an embodiment of the present disclosure.

Please refer to FIG. 2, FIG. 3 and FIG. 6. A plug column 31 is disposed on the driver component 3. The plug column 31 is used for electrically connecting the driver component 3 and the circuit board 2. A fastener 6 and a plug hole 23 are disposed on the circuit board 2. The fastener 6 is used for fastening the plug column 31. The plug column 31 passes through the plug hole 23. The fastener 6 and the plug column 31 are made of conductive material. To finish the installation of the driver component 3, insert the plug column 31 into the plug hole 23 and use fastener 6 to fasten the plug column 31.

Please refer to FIG. 3. The fastener 6 has a fastening seat 61 and two elastic chips 62. The fastening seat 61 is installed on the plug hole 23 and electrically connects with the circuit board 2. The two elastic chips 62 are disposed correspondingly on the fastening seat 61. The plug column 31 passes through the two elastic chips 62. The fastener 6 adopts this structure to simplify the fastening of the plug column 31.

Figure 4:
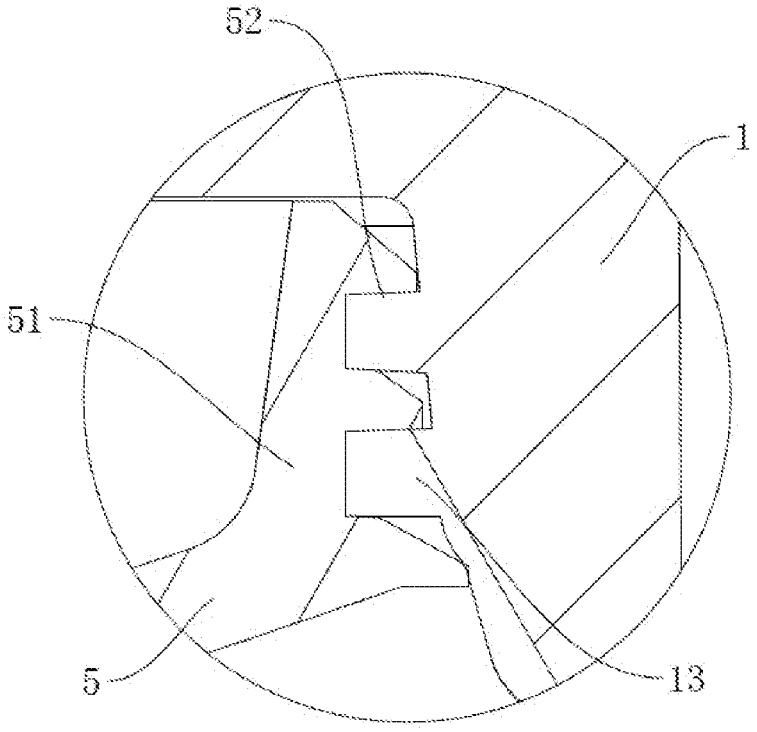
FIG. 4 is a partial view of the downlight apparatus according to an embodiment of the present disclosure.

Please refer to FIG. 2 to FIG. 4. A heat dissipation box 4 is disposed between the surface rim 1 and the circuit board 2. The heat dissipation box 4 is covered and disposed on an external of the driver component 3. The external wall of the heat dissipation box 4 engages on the inner wall of the installation cavity. The other side of the heat dissipation box 4 engages on the side wall of the surface rim 1 disposing an installation space. A containing cavity is disposed on the heat dissipation 4. The containing cavity is used for containing the driver component 3. An installation space is disposed on the bottom of the installation cavity of the surface rim 1. The shape of the installation space matches with the shape of the heat dissipation box 4. One side of the heat dissipation box 4 engages on the peripheral side of the circuit board 2. The other side of the heat dissipation box 4 engages on the side wall of the surface rim 1 disposing an installation space. The contact area of the circuit board 2 and the surface rim 1 is enlarged; therefore, the heat dissipation efficiency of the circuit board 2 and the driver component 3 is improved. The positioning hole 22 used for containing the positioning column 11 is also disposed on the heat dissipation box 4. The heat dissipation box 4 and the circuit board 2 are capable of being positioned at the same time to increase the production efficiency of the downlight.

In this embodiment, the heat dissipation box 4 has an inner tube, an external, an outer ring part and a connecting part. The bottom of the inner tube engages on the circuit board 2. The external is sleeve surrounding the inner tube. The external of the inner tube is spaced disposed to form the outer ring part. The connecting part is disposed on the end of the outer ring part being away from the circuit board 2. The connecting part is used for connecting the inner tube and the outer ring part. The side walls of the outer ring part, the connecting part and the inner tube surround and form a surrounding cavity containing the driver component 3. The heat dissipation box 4 is made of aluminum. The outer ring part, the inner tube and the connecting part are aluminum unibody stamping structures. A top side of the inner tube engages on the circuit board 2 to lead the heat generated by the circuit board 2 to the heat dissipation box 4. Further, the connection of the heat dissipation box 4 and the surface rim 1 enables the heat dissipation box 4 and the surface rim 1 to dissipate heat simultaneously, and further improve the heat dissipation efficiency.

In this embodiment, the heat dissipation box 4 has a tube part 41 and a fixing part 42. The tube part 41 is used for containing the driver component 3. The fixing part 42 is disposed on the opening part of the tube part 41 and engages on the circuit board 2. The heat dissipation box 4 is made of aluminum. The tube part 41 and the fixing part 42 are aluminum unibody stamping structures. The fixing part 42 engages on the circuit board 2 to lead the heat generated by the circuit board 2 to the heat dissipation box 4. Further, the connection of the heat dissipation box 4 and the surface rim 1 enables the heat dissipation box 4 and the surface rim 1 to dissipate heat simultaneously, and further improve the heat dissipation efficiency.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A downlight apparatus, comprising:

a light passing cover;

a light source module having a plurality of LED modules;

a surface rim having a rim part, a reflection part and a bottom part, the rim part connected to the reflection part, the reflection part being connected to a top edge of the bottom part, the bottom part defining an installation cavity with the top edge as a cavity opening, the rim part defining a light opening, a first light of the plurality of LED modules passing through the light passing cover and a second light of the plurality of LED modules being reflected by the reflection part before passing through the light passing cover, the rim part, the reflection part and the bottom part being made of the same material as a unibody module; and a driver plate, disposed upon the top edge of the bottom part, a first side of the driver plate being attached with the light source module, a second side of the driver plate being attached with at least one driver component, the first side facing to the light passing cover, the second side facing to the installation cavity, the at least one driver component being stored in the installation cavity, wherein positions of the multiple LED modules on the first side of the driver plate are kept away from the at least one driver component on the second side of the driver plate, wherein the multiple LED modules are located in a center area of the first side of the driver plate, the at least one driver component is located at a peripheral area of the second side of the driver plate.

2. The downlight apparatus of claim 1, further comprising a heat dissipation box made of heat conductive material, the heat dissipation box being placed into the installation cavity, and surrounding the at least one driver component.

3. The downlight apparatus of claim 2, wherein the heat dissipation box has a tube body with a bottom plate, an external wall of the tube body contact the inner wall of the bottom part of the surface rim.

4. The downlight apparatus of claim 2, wherein the heat dissipation box has a surrounding wall, a surrounding cavity and a central platform, the driver plate being placed on the central platform and covering the surrounding cavity, the at least one driver component being placed in the surrounding cavity.

5. The downlight apparatus of claim 4, wherein there are multiple cavity sections in the surrounding cavity for respectively storing different driver components.

6. The downlight apparatus of claim 5, wherein a processor circuit is placed in a first cavity section and a transformer circuit is placed in a second cavity section away from the first cavity section.

7. The downlight apparatus of claim 5, wherein the driver component with wireless communication function is placed at a different cavity section from other driver component without wireless communication function.

8. The downlight apparatus of claim 2, wherein the heat dissipation box is thermally connected with the bottom part of the surface rim.

9. The downlight apparatus of claim 1, wherein the reflective part is detachably connected to an attached device.

10. The downlight apparatus of claim 9, wherein the reflection part has a plug area for plugging in the attached device.

11. The downlight apparatus of claim 10, wherein the reflective part has a reflective wall, there is an entrance opening on the reflective wall for inserting the attached device, a surface wall of the attached device is integrated with the reflective wall appearing as a complete surrounding wall.

12. The downlight apparatus of claim 10, wherein a surface wall of the attached device has a reflection layer for reflecting the second light of the light source module.

13. The downlight apparatus of claim 9, wherein there is a coil concealed inside the reflective part for supplying power to the attached device.

14. The downlight apparatus of claim 13, wherein the attached device is placed in a container space concealed by the rim part and the reflective part.

15. The downlight apparatus of claim 1, wherein the multiple LED modules are located in a peripheral area of the first side of the driver plate, the at least one driver component is located at a center area of the second side of the driver plate.

16. The downlight apparatus of claim 1, wherein there is a second driver component disposed on the first side of the driver plate, a second height of the second driver component is smaller than a first height of the at least one driver component on the second side of the driver plate.

17. The downlight apparatus of claim 1, wherein the at least one driver component has a protruding pin from the second side of the driver plate passing through a through hole reaching a fastener on the first side of the driver plate for providing a driving current to the multiple LED modules.

18. The downlight apparatus of claim 1, wherein the at least one driver component, the driver plate and the light source are made as an integrated module to be placed into the installation cavity directly.

* * * * *